United States Patent [19]

Heil et al.

[11] Patent Number: 4,981,537

[45] Date of Patent: Jan. 1, 1991

[54] TAPE LAMINATING DEVICE

[75] Inventors: Robert H. Heil; Frederic A. Longworth, both of St. Paul, Minn.

[73] Assignee: Minnesota Mining and Manufacturing Company, St. Paul, Minn.

[21] Appl. No.: 383,164

[22] Filed: Jul. 20, 1989

[51] Int. Cl.[5] ..... B32B 31/08; B32B 35/00

[52] U.S. Cl. ..... 156/71; 156/157; 156/324; 156/527; 156/544; 156/577; 156/579; 225/34

[58] Field of Search ..... 156/157, 324, 523, 527, 156/544, 554, 577, 579, 71; 225/34, 88, 4; 242/55.3

[56] References Cited

U.S. PATENT DOCUMENTS

| | | | |
|---|---|---|---|
| Re. 30,787 | 11/1981 | Pool et al. | 156/527 |
| 3,193,433 | 7/1965 | Tillotson | 156/554 |
| 4,415,400 | 11/1983 | Rammelmeyr | 156/555 |
| 4,582,737 | 4/1986 | Torgerson et al. | 428/57 |

*Primary Examiner*—Michael Wityshyn
*Attorney, Agent, or Firm*—Donald M. Sell; Walter N. Kirn; William L. Huebsch

[57] ABSTRACT

A device with a first tape supply roll including a first length of tape helically wound about a first core with its adhesive coating on the side of its backing adjacent the core, a second tape supply roll comprising a second length of tape helically wound about a second core with its adhesive coating on the side of its backing opposite the core, and first and second hubs mounted on a frame for rotation about spaced parallel axes. The first hub is adapted to receive the core of the first tape supply roll and position a first edge of the first length of tape at a first predetermined position axially with respect to the first and second hubs, and the second hubs is adapted to receive the core of the second tape supply roll and position a first edge of the second length of tape at a second predetermined position axially with respect to the first and second hubs with the width of the first length of tape extending from the first position past the second position and the width of the second length of tape extending from the second position past the first position so that portions along the first edges of both lengths of tape are positioned between the first and second positions. Tapes are pulled from the first and second tape supply rolls along paths comprising a common path portion having a beginning position at which the portions along the first edges of both lengths of tape are adhered together to form a composite tape structure with a portion of a layer of adhesive exposed on each of its major sides.

6 Claims, 2 Drawing Sheets

TAPE LAMINATING DEVICE

TECHNICAL FIELD

The present invention relates to devices for use with first and second lengths of tape each comprising a backing having front and rear surfaces and opposite first and second elongate edges and a coating of pressure sensitive adhesive on the front surface to adhere together portions of the adhesive coatings along first edges on the lengths of tape to produce a composite tape structure having opposite edges defined by the second edges of the lengths of tape and exposed portions of the layers of adhesive along the second edges on the lengths of tapes along opposite major surfaces of the composite tape structure so that the exposed portion of adhesive layer along one major surface of the composite tape structure can be adhered along a surface to be masked with edges of the composite and the surface to be masked aligned, and a sheet cf masking material can then be adhered to the exposed portion of adhesive layer along the other major surface of the composite to complete coverage of the surface to be masked.

BACKGROUND ART

Devices are known for making the composite tape structure described above. Such devices are described in U.S. Pat. Nos. 4,582,737 and 4,415,400. The device described in U.S. Pat. No. 4,582,737, however, forms rolls of the composite tape structure for later use to mask a surface, in which rolls the exposed portions of the layers of adhesive along the edges of the composite tape can not be firmly releasably adhered to an adjacent wrap of the composite in the roll because of the greater thickness of the composite along its central portion, and thus are unduly exposed to contamination and deleterious effects of the atmosphere; whereas the device described in U.S. Pat. No 4,415,400, while being able to form the composite at the location at which it is to be used, is quite complex and does not easily lend itself to forming the composite as it is being applied to a surface to be masked.

DISCLOSURE OF INVENTION

The present invention affords easy manual formation of a composite tape structure of the type described above at the location at which it is to be used, and can easily form the composite as it is being applied to a surface to be masked.

According to the present invention there is provided a device comprising a first tape supply roll comprising a first length of tape helically wound about a first core with its adhesive coating on the side of its backing adjacent the core, a second tape supply roll comprising a second length of tape helically wound about a second core with its adhesive coating on the side of its backing opposite the core, and first and second hubs mounted on a frame for rotation about spaced parallel axes. The first hub is adapted to receive the core of the first tape supply roll and position a first edge of the first length of tape at a first predetermined position axially with respect to the first and second hubs, and the second hub is adapted to receive the core of the second tape supply roll and position a first edge of the second length of tape at a second predetermined position axially with respect to the first and second hubs with the width of the first length of tape extending from the first position past the second position and the width of the second length of tape extending from the second position past the first position so that portions along the first edges of both lengths of tape are positioned between the first and second positions. Means are provided for defining paths for the first and second lengths of tape from the first and second tape supply rolls comprising a common path portion having a beginning position at which the portions along the first edges of both lengths of tape are adhered together to form the composite tape structure.

The device is portable, and the frame includes a handle adapted for manual engagement to manipulate the device so that an end portion of the composite tape structure can be adhered along a surface to be masked, and the device can then be moved along that surface to form a sufficient length of the composite structure to extend entirely across the surface to be masked.

Preferably the beginning position of the common path portion is defined by the periphery of the second tape supply roll, and the means for defining the common path portion comprises a roller having a peripheral surface that restricts adhesion to the layer of adhesive on the first length of tape, which roller is mounted on the frame for rotation about an axis parallel to the axes of the hubs at a position spaced from the second hub and on the same side of the common path portion as the second hub, and the device further includes a cutting blade mounted on the frame transverse of said common path portion adjacent the roller and on the side of the roller opposite the second hub, which blade is positioned to afford engagement between the blade and the composite tape structure extending past the roller to sever a length of the composite tape structure from the tape on the device.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
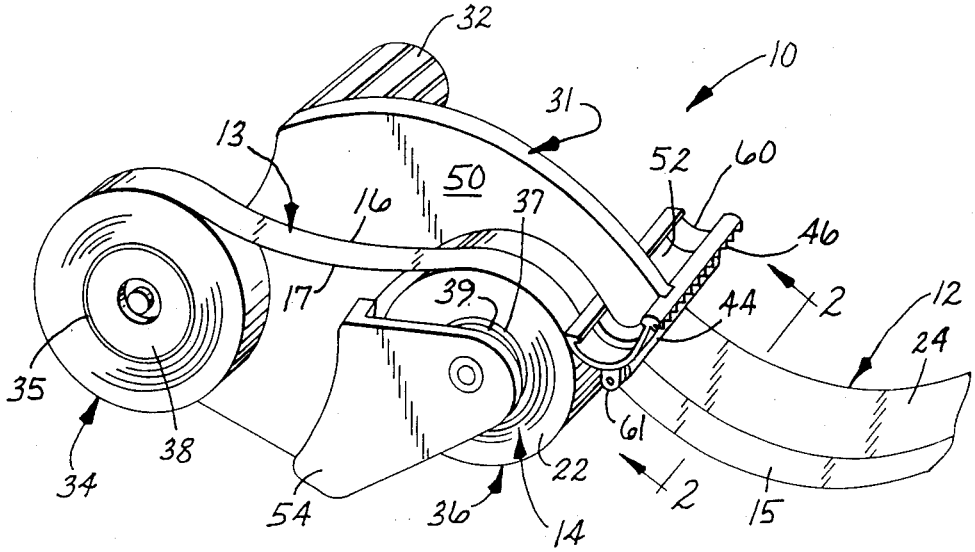
FIG. 1 is a perspective view of a device according to the present invention for forming a composite tape structure.

Referring now to the drawing, there is shown a device 10 according to the present invention for forming a composite tape structure 12.

Figure 2:
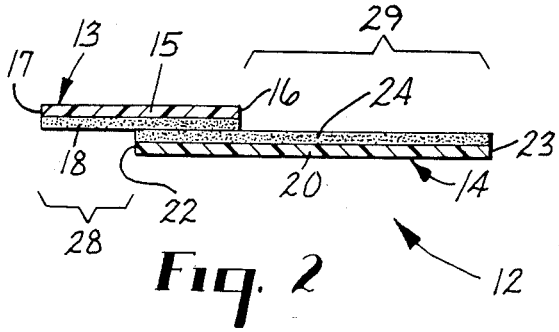
FIG. 2 is an enlarged sectional view of the composite tape structure taken approximately along line 2—2 of FIG. 1.
Figure 3:
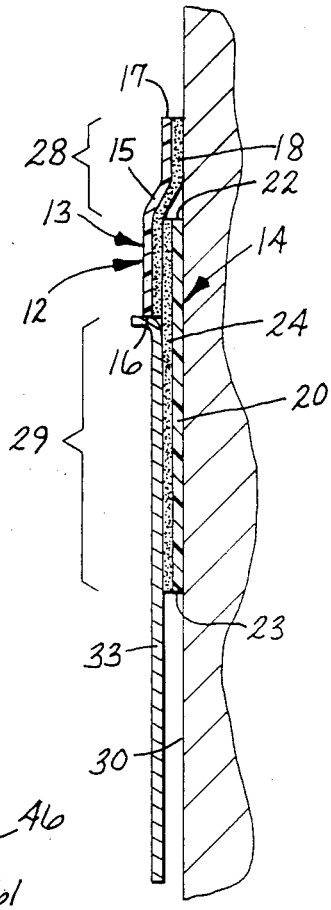
FIG. 3 is an enlarged sectional view illustrating using the composite tape structure of FIG. 1 to adhere a sheet of masking material to a surface.
Figure 4:
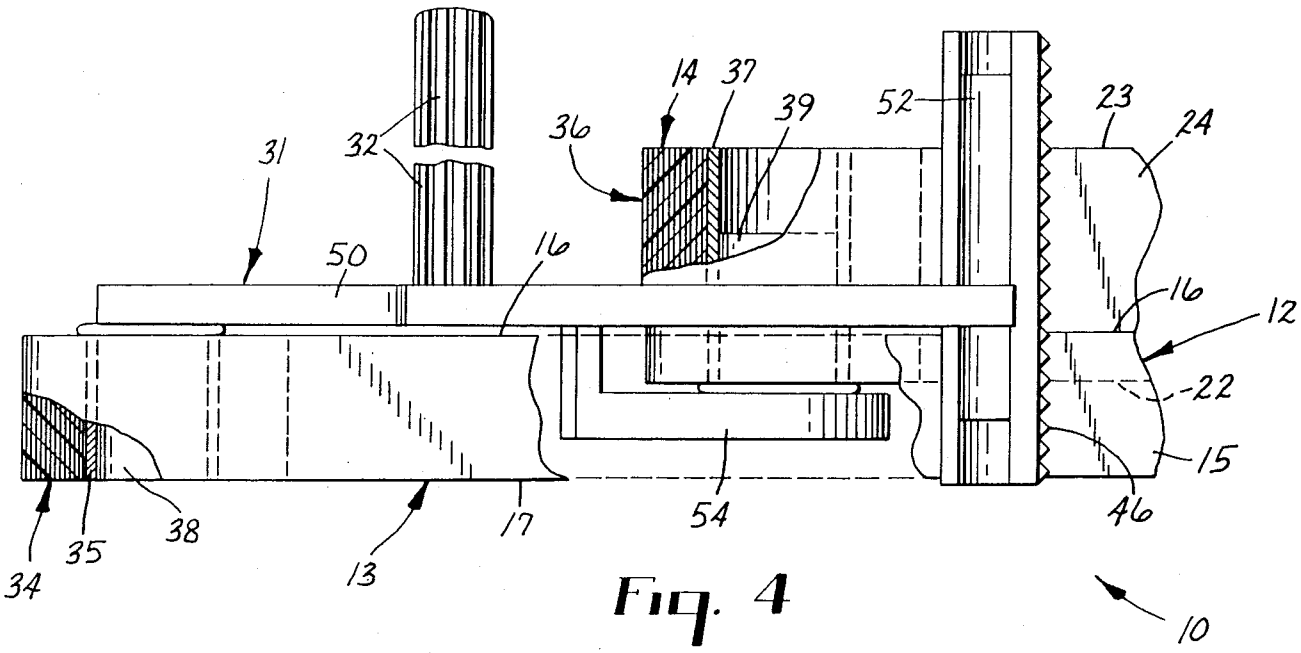
FIG. 4 is an enlarged top view of the device of FIG. 1 having parts broken away to show detail.

The device 10 is for use with first and second lengths of tape 13 and 14. As can best be seen in FIG. 2, the first length of tape 13 comprises a backing 15 having front and rear surfaces and opposite first and second elongate edges 16 and 17 and a coating 18 of pressure sensitive adhesive on its front surface, whereas the second length of tape 14 comprises a backing 20 having front and rear surfaces and opposite first and second elongate edges 22 and 23 and a coating 24 of pressure sensitive adhesive on its front surface. The device 10 is adapted to adhere together portions of the coatings 18 and 24 of adhesive along the first edges 16 and 22 on the lengths of tape 13 and 14 to produce the composite tape structure 12 which has opposite edges defined by the second edges 17 and 23 of the lengths of tape 13 and 14 and exposed portions 28 and 29 of the coatings 18 and 24 of adhesive along the second edges 17 and 23 on the lengths of tapes 13 and 14 along opposite major surfaces of the composite tape structure 12 so that as is illustrated in FIG. 3, the exposed portion 28 of the coating 18 of adhesive along, one major surface of the composite tape structure 12 can be adhered along a surface 30 to be masked with the edge of the composite tape structure 12 defined by the edge 17 of the first length of tape 13 aligned with an edge of the surface 30 to be masked, and a sheet 33 of masking material (e.g., paper or polymeric film) can then be adhered to the exposed portion 29 of the coating 24 of adhesive along the other major surface of the composite tape structure 26 to complete coverage of the surface 30 to be masked.

The device 10 is portable, and comprises a frame 31 including a cylindrical handle 32 adapted for manual engagement to manipulate the device 10 so that, for example, an end portion of the composite tape structure 12 can be adhered along a surface to be masked, and the device 10 can then be moved along that surface to form a sufficient length of the composite tape structure 12 to extend entirely across the surface to be masked, or alternatively a user can hold the device 10 by the handle 32 in one hand and pull a desired length of the composite tape structure 12 from the device 10 with his other hand.

The device 10 comprises a first tape supply roll 34 comprising a first core 35 having a periphery and a central opening and the first length 13 of tape helically wound about the periphery of its core 35 with the adhesive coating 18 of the first length 13 of tape on the side of its backing 15 adjacent the core 35 (e.g., a ¾ to 2 inch wide roll of any of the various masking tapes or the duct tape sold by Minnesota Mining and Manufacturing Company, St. Paul, Minn.); a second tape supply roll 36 comprising a second core 37 having a periphery and a central opening and the second length 14 of tape helically wound about the periphery of its core 37 with the coating 24 of adhesive of the second length 14 of tape on the side of its backing 20 opposite the core 37 (e.g., a ¾ to 2 inch wide tape that provides high adhesion to paper or polymeric materials); and first and second hubs 38 and 39 mounted on the frame 31 for rotation about spaced parallel axes. The first hub 38 is adapted to frictionally receive the core 35 of the first tape supply roll 34 and position the first edge 16 of the first length 13 of tape at a first predetermined position with respect to the axis of the first and second hubs 38 and 39, and the second hub 39 is adapted to receive the core 37 of the second tape supply roll 36 and position the first edge 22 of the second length 14 of tape at a second predetermined position with respect to the axis of the first and second hubs 38 and 39, with the width of the first length 13 of tape extending from that first position past the second position and the width of the second length 14 of tape extending from that second position past the first position so that portions along the first edges 16 and 22 of both lengths 13 and 14 of tape (e.g., about 0.64 centimeter or 0.25 inch wide) are positioned between those first and second positions. Means are provided for defining paths for the first and second lengths 13 and 14 of tape along which they may be pulled from the first and second tape supply rolls 34 and 36 comprising a common path portion having a beginning position defined by the periphery of the second tape supply roll 36, at which beginning position the portions along the first edges 16 and 22 of both lengths 13 and 14 of tape between those first and second positions are adhered together to form the composite tape structure 12.

Figure 5:
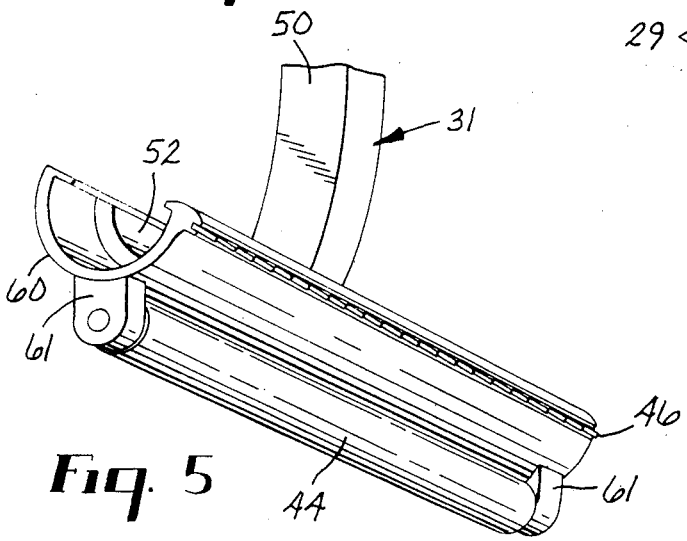
FIG. 5 is a fragmentary enlarged perspective view of a portion of the device of FIG. 1.

The means for defining the common path portion also comprises a roller 44 over which the composite tape structure 26 can be guided as it is pulled from the device 10 (see FIG. 5). The roller 44 has a peripheral surface that restricts adhesion to the exposed portion 28 of the layer 18 of adhesive on the first length of tape 13, both because it is of a small diameter (e.g., 0.76 centimeter or 0.3 inch diameter) and because it is of a polymeric material to which adhesives do not easily adhere, e.g., nylon or polypropylene. The roller 44 is mounted on the frame 31 for rotation about an axis parallel to the axes of the hubs 38 and 39 at a position spaced from the second hub 39 and on the same side of the common path portion as the second hub 39. The device 10 further includes a cutting blade 46 mounted on the frame 31 transverse of the common path portion adjacent the roller 44 and on the side of the roller 44 opposite the second hub 39, which blade 46 has a row of generally triangular teeth adapted for severing the composite tape structure 12 and is positioned to afford being manually brought into engagement with the composite tape structure 12 extending past the roller 44 to sever it, the blade 46 is oriented so that it will engage the composite tape structure 12 at about ninety degrees (i.e., 90 degrees between the major side surface of the blade 46 and the major surface of the composite tape structure 12) as the blade is moved into engagement with the composite tape structure tensioned around the roller 44.

The frame 31 of the device 10 (which is essentially the same as the frame of a dispenser currently sold under the trade designation "Paper Taper (T.M.) Masking Machine", Model H-4Z, by the Contractor Products Division of Minnesota Mining and Manufacturing Company) comprises a main generally planar portion 50 having the first hub 38 mounted on one major side surface, the handle 32 projecting from the other major side surface, and a transversely extending generally semi cylindrical shoe 52 at its end opposite the first hub 38; and a generally L-shaped offset portion 54 between the first hub 35 and the shoe 52 and projecting from the side of the main portion 50 on which the first hub 38 is mounted, which generally L-shaped portion 54 includes a part parallel to the main portion 50 on which the second hub 39 is rotatably mounted on its side opposite the first hub 38, with the offset portion 54 affording engagement of the first length of tape 13 from the first hub 38 with the periphery of the second length 14 of tape on the second hub 39 with the edges 16 and 22 in the first and second predetermined positions with respect to the axes of the hubs 38 and 39 as is described above.

The blade 46 and roller 44 are mounted on an elongate channel 60 having a generally C-shaped cross section with the roller being rotatably mounted between journal posts 61 projecting radially outwardly centrally from the ends of an outer generally cylindrically convex surface of the channel 60, which journal posts 61 have aligned openings receiving trunnions on the ends of the roller 44; and the blade 46 having a portion spaced from its teeth embedded along one edge of the channel 60. The channel 60 may either be slid longitudinally along the shoe 52 to afford aligning its end adjacent the path for the first length of tape 13 with the second edge 17 of the first length of tape as may be necessary to accommodate first lengths of tape 13 of different widths, or may be adapted to be engaged over the shoe at different locations along its length for that purpose, and may have portions (e.g., such as portions defining a series of openings on the channel 60) any one of which is adapted to be engaged by a portion such as a pin on the shoe to locate the channel longitudinally along the shoe 52 in a manner similar to engagement and location of the guide bar 82 with the shoe 84 with the pin 92 received in one of the openings 94 as is described in U.S. Pat. No. Re. 30,787, the content whereof is incorporated herein by reference.

The first and second tubs 38 and 39 are mounted on the frame 31 for rotation about their spaced parallel axes by structure similar to the structure described in U.S. Pat. No. Re. 30,787 with respect to FIG. 5 of that patent for mounting the hub 22, with the mounting structure for the hubs 38 and 39 providing a slight resistance to rotation of the hubs 38 and 39 so that the first and second lengths 13 and 14 of tape will be tensioned as they are pulled from the device 10, and the first length of tape 13 will thus be pulled into firm engagement with the periphery of the second tape supply roll 36 to provide firm and smooth engagement between the adhesive coatings 18 and 24 on the lengths 13 and 14 of tape. Preferably both hubs 38 and 39 are adapted to receive cores 35 and 37 having an inside diameters of one inch, which allows wrapping greater lengths 13 and 14 of the tapes around the cores 35 and 37 for a given outside diameter of the supply rolls 34 and 36.

The present invention has now been described with reference to one embodiment thereof. It will be apparent to those skilled in the art that many changes can be made in the embodiment described without departing from the scope of the present invention. Thus the scope of the present invention should not be limited to the structure described in this application, but only by structures described by the language of the claims and the equivalents of those structures.

I claim:

1. A device for dispensing first and second lengths of tape each comprising a backing having front and rear surfaces and opposite first and second elongate edges and a coating of pressure sensitive adhesive on said front surface, said device adhering together portions of the adhesive coatings along first edges on the lengths of tape to produce a composite tape structure having opposite edges defined by the second edges of the lengths of tape and exposed portions of the coatings of adhesive along said second edges on the lengths of tape along opposite major surfaces of the composite tape structure so that the exposed portion of the coating of adhesive along one surface of the composite tape structure can be adhered along a surface to be masked with edges of the composite tape structure and the surface to be masked aligned, and a sheet of masking material can then be adhered to the exposed portion of the coating of adhesive along the other major surface of the composite tape structure to complete coverage of the surface to be masked, said device comprising:

a first tape supply roll comprising a first core having a periphery and a central opening and said first length of tape helically wound about said periphery with the coating of adhesive of the first length of tape on the side of the backing adjacent the first core;

a second tape supply roll comprising a second core having a periphery and a central opening and said second length of tape helically wound about said periphery of said second core with the coating of adhesive of the second length of tape on the side of the backing opposite the second core;

a frame;

first and second hubs mounted on said frame for rotation about spaced parallel axes, said first hub being adapted to receive the core of said first tape supply roll and position the first edge of the first length of tape at a first predetermined position axially with respect to said first and second hubs, and said second hub being adapted to receive the core of said second tape supply roll and position the first edge of the second length of tape at a second predetermined position axially with respect to said first and second hubs with the width of said first length of tape extending from the first position past the second position and the width of the second length of tape extending from the second position past the first position so that portions along the first edges of both lengths of tape are positioned between said first and second positions; and means for defining paths for said first and second lengths of tape from said first and second tape supply rolls comprising a common path portion having a beginning position at which said portions along the first edges of both lengths of tape are adhered together to form the composite tape structure.

2. A device according to claim 1 wherein said beginning position of said common path portion is defined by the periphery of said second tape supply roll, and said means for defining said common path portion further comprises a roller having a peripheral surface that restricts adhesion to the coating of adhesive on said first length of tape, said roller being mounted on said frame for rotation about an axis parallel to the axes of said hubs at a position spaced from said second hub.

3. A device according to claim 1 wherein said beginning position of said common path portion is defined by the periphery of said second tape supply roll, and said means for defining said common path portion further comprises a roller having a peripheral surface that restricts adhesion to the coating of adhesive on said first length of tape, said roller being mounted on said frame for rotation about an axis parallel to the axes of said hubs at a position spaced from said second hub; and said device further includes a cutting blade mounted on said frame transverse of said common path portion adjacent said roller and on the side of said roller opposite said second hub, said blade being positioned to afford engagement between said blade and the composite tape structure extending past said roller.

4. A device according to claim 1 wherein said device is portable, and said frame includes a handle adapted for manual engagement to manipulate said device.

5. A method using first and second lengths of tape each comprising a backing having front and rear surfaces and opposite first and second elongate edges and a coating of pressure sensitive adhesive on said front surface for adhering together portions of the coatings of adhesive along first edges on the lengths of tape to produce a composite tape structure having opposite edges defined by the second edges of the lengths of tape and exposed portions of the coatings of adhesive along said second edges on the lengths of tape along opposite major surfaces of the composite tape structure so that the exposed portion of the coating of adhesive along one surface of the composite tape structure can be adhered along a surface to be masked with edges of the composite tape structure and the surface to be masked aligned, and a sheet of masking material can then be adhered to the exposed portion of the coating of adhesive along the other major surface of the composite tape structure to complete coverage of the surface to be masked, said method comprising:

helically winding the first length of tape around the periphery of a first core with the coating of adhesive of the first length of tape on the side of the backing adjacent the first core;

helically winding the second length of tape around the periphery of a second core with the coating of adhesive of the second length of tape on the side of the backing opposite the second core;

mounting the cores on a frame for rotation about spaced parallel axes with the first edge of the first length of tape at a first predetermined position with respect to said axes, and the first edge of the second length of tape at a second predetermined position with respect to said axes and with the width of said first length of tape extending from the first position past the second position and the width of the second length of tape extending from the second position past the first position so that portions along the first edges of both lengths of tape are positioned between said first and second positions; and moving said tapes along a common path portion having a beginning position at which said portions along the first edges of both lengths of tape are adhered together.

6. A method according to claim 5 wherein the beginning position of the common path portion is defined by the periphery of the second length of tape wound around the second core, and said step of moving said first and second lengths of tape along a common path portion includes pulling said first length of tape into firm engagement with the periphery of the second length of tape wound around the second core.

* * * * *